US005259454A

United States Patent [19]

Bretz, Jr. et al.

[11] Patent Number: 5,259,454

[45] Date of Patent: Nov. 9, 1993

[54] PROCESS FOR CONTROLLING OIL WELL FIRES

[75] Inventors: Thomas E. Bretz, Jr., Kirtland; Joseph D. Renick, Albuquerque; George Y. Baladi, Albuquerque; Wesley D. Tucker, Albuquerque, all of N. Mex.

[73] Assignee: The United States of America as represented by the Secetary of the Air Force., Washington, D.C.

[21] Appl. No.: 868,600

[22] Filed: Apr. 14, 1992

[51] Int. Cl.[5] ..... E21B 43/12

[52] U.S. Cl. ..... 166/297; 169/69

[58] Field of Search ..... 166/297, 299, 63; 169/69

[56] References Cited

U.S. PATENT DOCUMENTS

| | | | |
|---|---|---|---|
| 2,449,037 | 9/1948 | Harkness | 166/299 X |
| 3,857,255 | 12/1974 | Elwood et al. | 62/293 |
| 3,905,424 | 9/1975 | Elwood et al. | 169/46 |
| 4,436,154 | 3/1984 | Vann et al. | 166/281 |

OTHER PUBLICATIONS

Ewing, Lee (Times Staff Writer), "AF Studies Bombing of Oil Fires," Air Force Times, Apr. 1, 1991.

"N.M. Scientists Work to Stifle Kuwait Oil Fires," Albuq. Journal, Apr. 5, 1991.

Fleck, John (Journal Staff Writer), "KAFB Tests Ways to Snuff Oil Fires," Albuq. Journal, Apr. 5, 1991.

Broad, William J., Controlling Oil Well Fires, New York Times, Apr. 9, 1991.

*Primary Examiner*—William P. Neuder

*Attorney, Agent, or Firm*—Donald J. Singer; Stanton E. Collier

[57] ABSTRACT

Conventional bombs or commercially available explosives are selectively placed about well pipes and exploded to cause closure of the well pipe and thus resulting in substantial reduction in the flow of oil and gas to facilitate extinguishing the fire thereon. Explosive charges are selectively placed about the well pipes in slanting holes so to remove the cellar assembly, make a ramp to the well pipe, and to close the well pipe.

20 Claims, 4 Drawing Sheets

PROCESS FOR CONTROLLING OIL WELL FIRES

STATEMENT OF GOVERNMENT INTEREST

The invention described herein may be manufactured and used by or for the Government for governmental purposes without the payment of any royalty thereon.

BACKGROUND OF THE INVENTION

The present invention relates to controlling fires, and, in particular, to oil well fires.

The oil well fires of concern to the present invention are those that exist above the surface wherein the oil and/or gas is exiting from or near the wellhead that has been damaged.

The present process used to extinguish oil well fires involves the application of continuous amounts of water in large volumes in the area about the source of the fire. This serves to cool any structures that could re-ignite the fire and allows personnel to approach the fire area to actually extinguish the fire using explosives. Of course, the oil and gas are still issuing from the well. The personnel must now enter this area and cap the wellhead. Although this process has worked in the past several disadvantages exist. For example, a large source of water must be near the wellhead. Also, the oil and gas may re-ignite.

Another process for controlling the fire is to stop the flow of hydrocarbon fluids by drilling a second well bore adjacent to the problem well bore. The second well bore is slanted to closely meet the first well bore. A shaped charge can open up channels through which cement can be placed to stop the flow. U.S. Pat. No. 4,436,154 discloses such in a well having two payzones of highly different pressures.

Where the pipe casing is easily reached, for example, at sea, a cryogenic control valve can be installed stop the flow and then direct the flow to another well head.

The need to develop means for controlling oil well fires was documented in a New York Times article by William Broad as related to the oil well fires in Kuwait. It is noted therein that the problem is two fold: (1) putting the fire out and (2) capping the well. Some ideas advanced include putting 100 ton concrete caps on the burning well to stop the flames; using super cold foams; putting explosives collars on the pipes using implosion technology to seal the pipes; putting a cryogenic valve on the wellhead like the above patent.

Thus, there is a need for a process to control oil well fires with a minimum of equipment and time.

SUMMARY OF THE INVENTION

The present invention involves processes to control oil well fires.

The first process uses at least one standard bomb having an explosive charge placed thereon with an explosive cord (detonating cord) connected thereto. A detonator is connected to the explosive cord. The bomb is placed underground in a trench or a shaft augered in close proximity of the well pipe. Upon detonation, the force causes either partial or full closure of the well pipe without further damage. Two bombs may be physically placed such that they straddle the well pipe. The bomb may be air dropped or physically placed in position.

In the other process, explosives are placed in augered shafts underground at inclined angles to the well pipe. These explosives accomplish several results: (1) They remove dirt to create a ramp for access to the well pipe; (2) they remove the cellar; and (3) they can crimp the well pipe. These explosives are physically placed in the proximity to the wellhead.

These processes can be applied in the ground, water or air.

Therefore, one object of the present invention is to provide a process for controlling oil well fires with high explosives placed in close proximity to the well pipe.

Another object of the present invention is to provide a process to create a ramp and/or crater about the well pipe to allow access of people and equipment to the well pipe.

Another object of the present invention is to provide a process of removing the cellar which may be impeding access to the well pipe.

Another object of the present invention is to provide a process to create a ramp, remove the cellar and to crimp the well pipe in one operation.

Another object of the present invention is to provide a process that minimizes equipment and time to stop oil well fires.

Another object of the present invention is to provide a process to either partial close or fully close the oil well pipe.

Another object of the present invention is to provide a process to remove casings to reach the inner oil bearing tube.

These and many other objects and advantages of the present invention will be readily apparent to one skilled in the pertinent art from the following detailed description of a preferred embodiment of the invention and the related drawings.

DESCRIPTION OF THE PREFERRED EMBODIMENT

Figure 1:
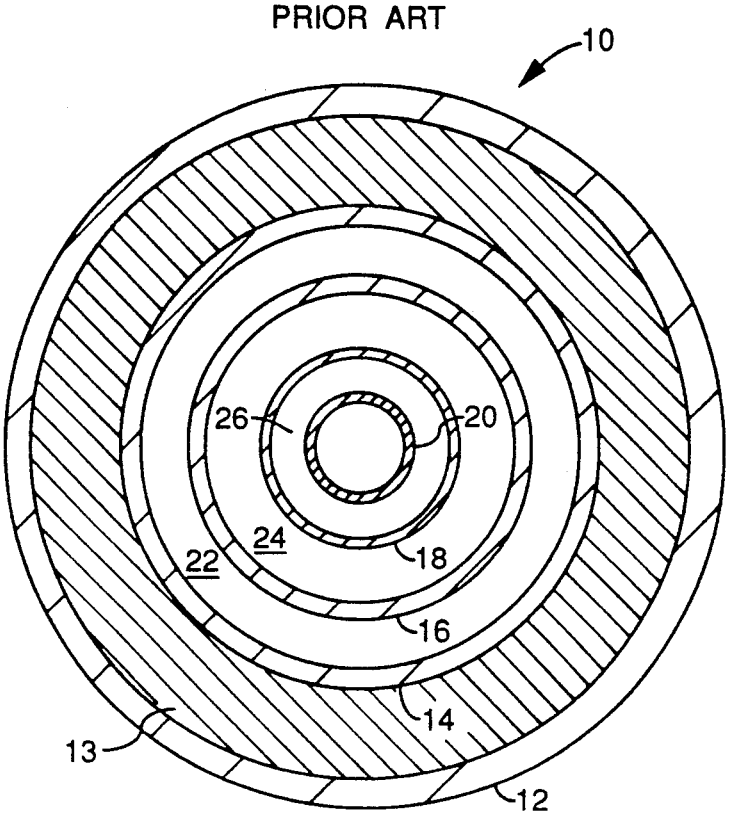
FIG. 1 PRIOR ART
FIG. 1 illustrates a typical oil well pipe in cross section.

FIG. 1 illustrates a conventional oil well pipe 10 being approximately 20 inches in diameter having 5 concentric pipes 12, 14, 16, 18 and 20. The space 13 between pipes 12 and 14 is typically filled with a weak sand-cement mixture. During the testing of the present process, the annuli 22, 24 and 26 were filled with water and the inner pipe 20 was filled with a fluid material simulating oil having a density of about 0.25 grams/cc. This arrangement simulates a production oil well pipe.

Figure 6:
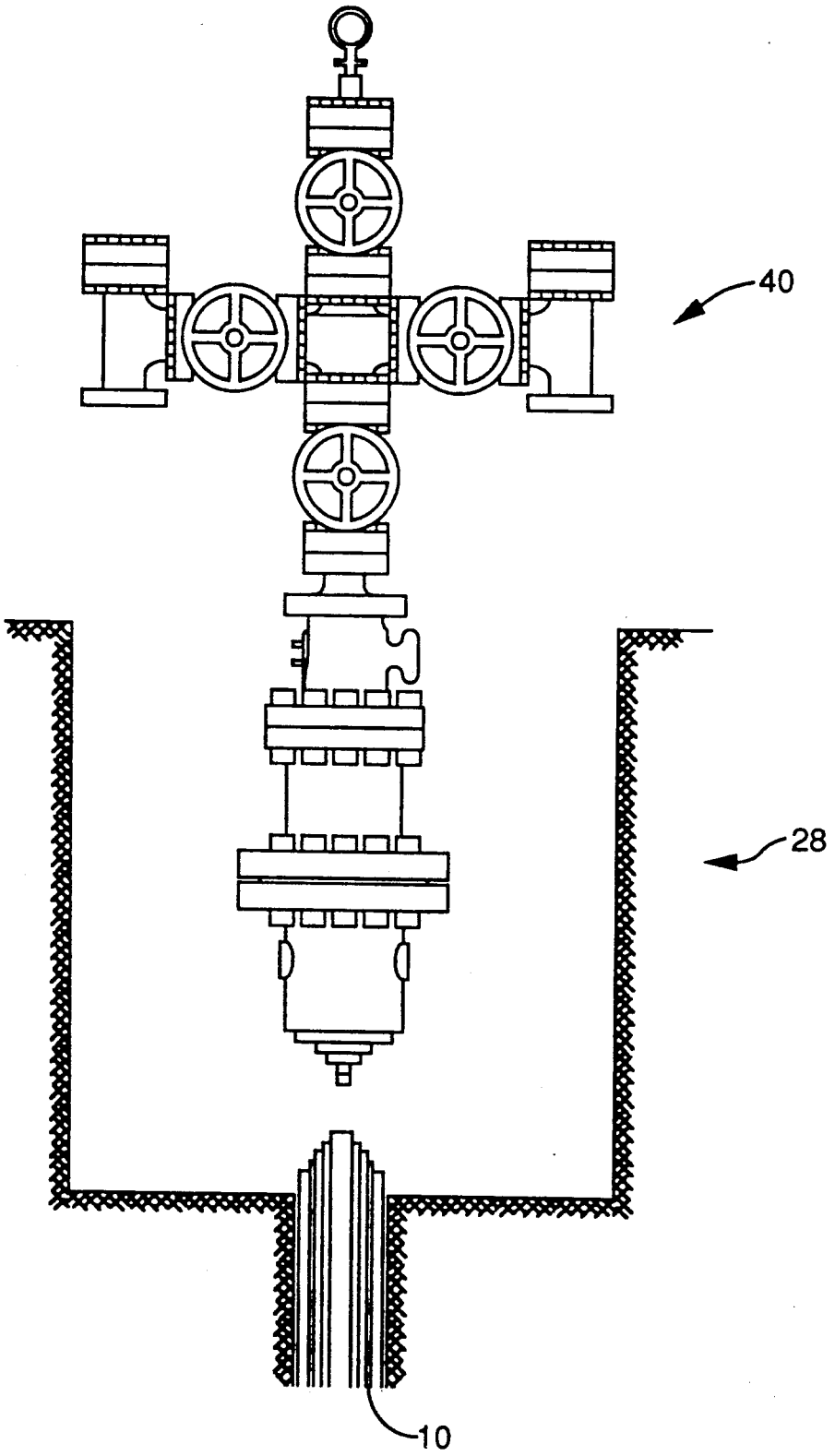
FIG. 6 PRIOR ART
FIG. 6 illustrates a wellhead.

Referring to FIG. 6, a cellar 28 is typically placed on top of the well pipe 10 and a Christmas tree 40 is connected to the well pipe 10 in the cellar 28.

Figure 2:
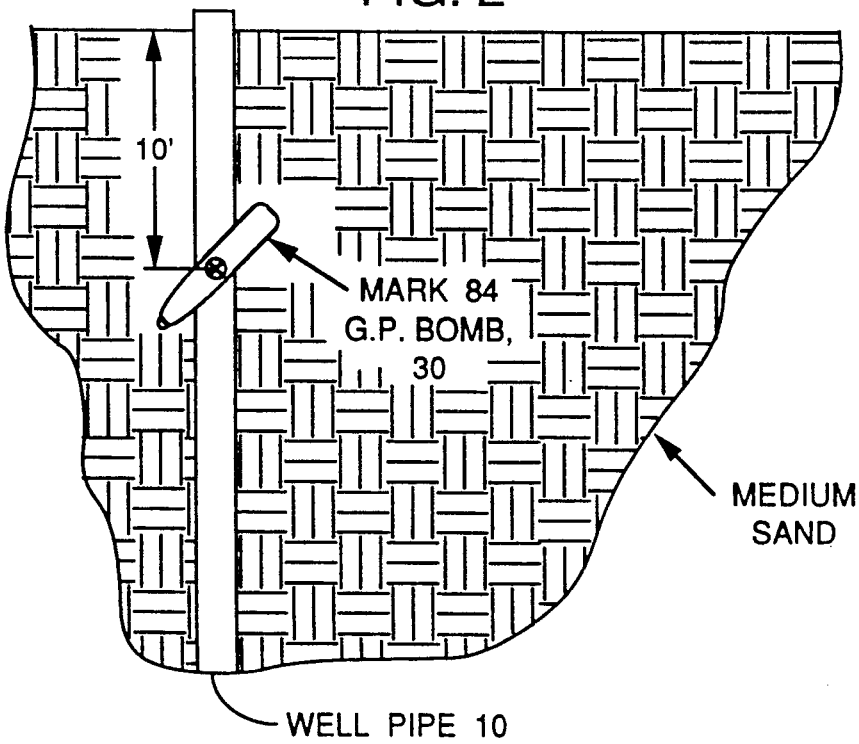
FIG. 2 illustrates a single bomb placed near to the oil well pipe.

Referring to FIG. 2, a standard bomb 30 such as a Mark 84, 2000 lbs., a Mark 82, 500 lbs., etc. is placed underground near the well pipe 10. Means for exploding the bomb 30 could include a charge placed in the fuse well, not shown, an explosive cord to the charge, and a detonator connected to the cord. A conventional power source causes the detonator to initiate.

Several factors are determinative of the well pipe closure: the size of the bomb, the distance of the bomb from the well pipe, the orientation of the bomb to the well pipe, the number of bombs, the density of the soil about the well pipe, etc.

The placement of the bomb 30 near the well pipe 10 can be accomplished by drilling a shaft 34. See FIG. 5. A conventional drilling rig 36 would be placed within about two hundred feet of the wellhead and the shaft 34 drilled at an angle of preferably 5 to 10 degrees from the horizontal. This shaft 34 could be augered to a point within a prescribed distance from the well pipe 10. A PVC pipe can be inserted into the shaft 34 for preventing collapse, for ease of the bomb 34 insertion, and for placement of high explosives therein as shown in FIGS. 4A and 4B.

FIG. 2 illustrates a single bomb 30 placed about 10 feet underground at a slant angle to the pipe. The axis of the bomb is perpendicular to the well pipe axis.

Figure 3A:
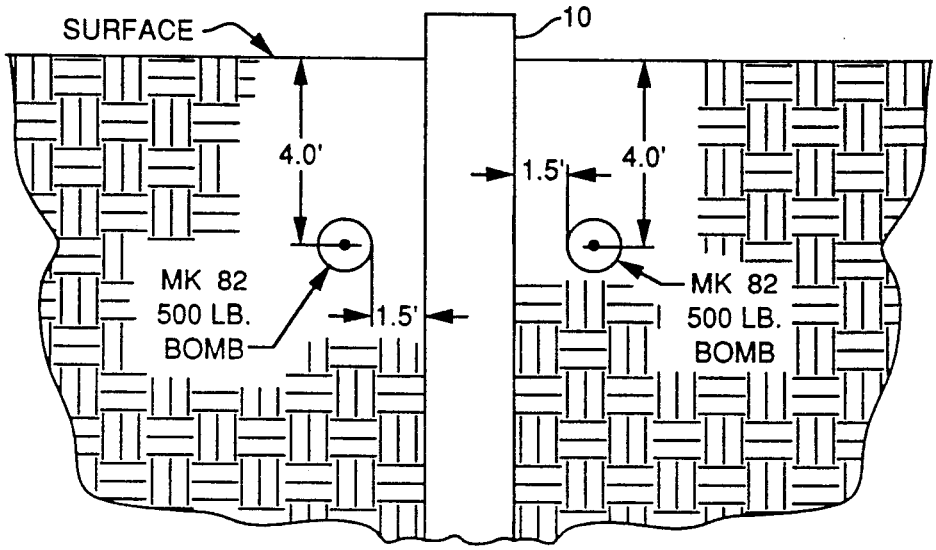
FIGS. 3A and 3B illustrate two bombs placed astride an oil well pipe.
Figure 3B:
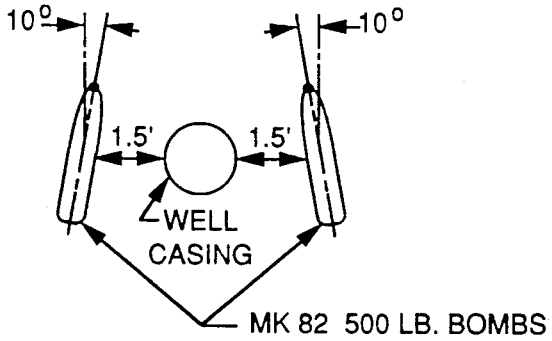

FIGS. 3A and 3B illustrate the use of two Mark 82 bombs 30 placed astride the well pipe 10 at the distances indicated. The bomb axes are slanted 10 degrees toward the well pipe axis.

Figure 4A:
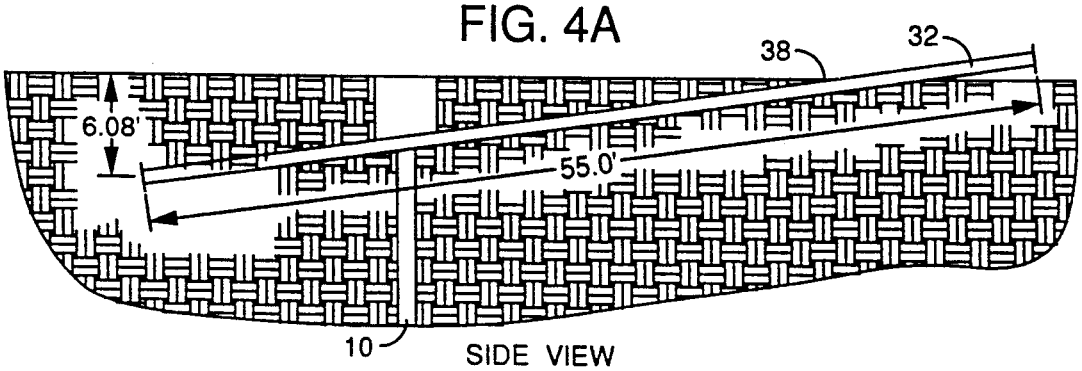
FIGS. 4A and 4B illustrate explosives astride an oil well pipe having a cellar assembly thereon.
Figure 4B:
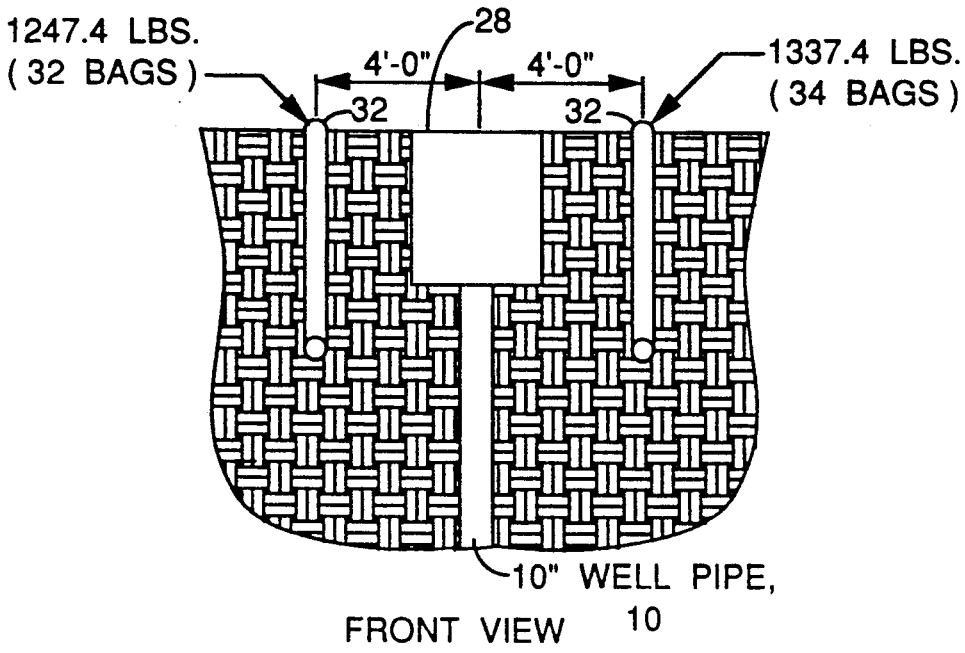
Figure 5:
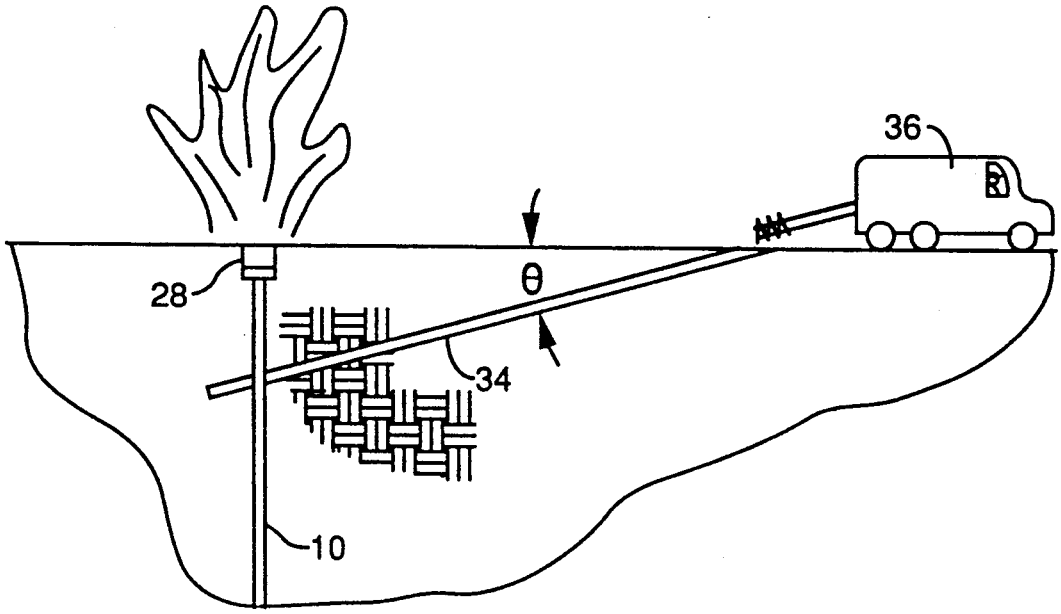
FIG. 5 illustrates placing the auger shaft near the well pipe.

FIGS. 4A and 4B illustrate the use of high explosives 32 such as ammonium nitrate fuel oil (ANFO) or other commercially available explosives to crimp well pipe 10, remove the cellar assembly 28 and produce an earthen ramp to the wellhead area. In these Figures, 2 PVC pipes 38 are filled with ANFO explosives. The shafts 34 are drilled at appropriate angles and distances and the PCV pipes 38 and explosives 32 are placed therein. Similar detonation techniques are used as in the above.

The testing of the FIG. 3 configuration had pairs of Mark 82 bombs 30 straddling the well pipe 10 at distances of 1.5 feet, 0.5 feet and touching the well pipe. The rear fuse well was packed with 1½ pounds of C-4 explosive material and fired with a double 54 grain prima cord from a RP 83 detonator.

The greatest degree of closure occurred when the bombs were put in contact with the exterior pipe casing. Other tests at different stand-off distances resulted in 95% to 99% closure without cracking the casings.

The testing of the FIG. 4 configuration indicated that at a distance of 3 feet from a well pipe filled with fluid the pipe would be closed.

The above processes may be used in a water environment to crimp the well pipes.

For excavation purposes, the detonation of either explosives or bombs in the slant holes results in a crater about 15 feet deep and 40 feet across. The well pipe casings is exposed and undamaged. The cellar and other debris is blown away. The tree also remains on top of the well casing.

For crimping the well pipe, the explosives or bombs are placed closer. Unless placed in direct contact, the crimps only partially block the flow of oil and/or gas. If the casing is not crimped during the excavation, it can be done afterwards. Once crimped, the pipe can be capped after the fire is stopped.

Once the well pipe is exposed, the casing layers can be removed with shaped charges allowing access to the inner tube which can be tapped or cut or sealed.

Clearly, many modifications and variations of the present invention are possible in light of the above teachings and it is therefore understood, that within the inventive scope of the inventive concept, the invention may be practiced otherwise than specifically claimed.

What is claimed is:

1. A process for controlling an oil well fire, the fire resulting from damage to a wellhead, said process comprising the steps of:

drilling at least one slant shaft having an end in close proximity to a well pipe;

placing in the at least one shaft explosives having means thereon for remote detonation; and detonating the explosives in each shaft to effect substantial closure of the well pipe to reduce the flow of oil and/or gas therefrom.

2. A process as defined in claim 1 wherein at least 2 shafts are drilled.

3. A process as defined in claim 1 wherein 2 shafts are drilled straddling the well pipe.

4. A process as defined in claim 3 wherein the center lines of each shaft converge in a common plane and have the well pipe centered therebetween.

5. A process as defined in claim 1 wherein the shafts are about four feet under the ground surface in the proximity of the well pipe.

6. A process as defined in claim 1 wherein the shafts are about four feet under a cellar assembly.

7. A process as defined in claim 5 wherein the shafts are at a distance from about 0 to about 2 feet from the well pipe casing.

8. A process as defined in claim 1 wherein the explosives are standard bombs such as a Mark 82, 500 pound, and a Mark 84, 2000 pound bombs.

9. A process as defined in claim 1 wherein the explosives are linear charges along the slant shaft.

10. A process for controlling an oil well fire, the fire resulting from damage to a wellhead having a cellar assembly thereon, said process comprising the steps of:

drilling at least one slant shaft past the cellar assembly and the well pipe;

placing in the at least one shaft an explosive material having means thereon for remote detonation; and detonating the explosive material in each shaft to effect substantial closure of the well pipe, removal of the cellar assembly, and removal of the surrounding earth to provide a access to the exposed well pipe.

11. A process as defined in claim 10 wherein at least 2 shafts are drilled.

12. A process as defined in claim 10 wherein 1 shaft is drilled straddling the well pipe.

13. A process as defined in claim 10 wherein the slant of the slant shaft is from about 5 to about 20 degrees.

14. A process as defined in claim 13 wherein the slant is about 5 degrees.

15. A process as defined in claim 10 wherein the slant holes are about 50 to 200 feet long.

16. A process as defined in claim 15 wherein the center lines of the slant holes converge in a common plane and have the well pipe centered therebetween.

17. A process as defined in claim 13 wherein the slant shafts are about 50 to 200 feet long.

18. A process as defined in claim 17 wherein the center lines of the slant holes converge in a common plane and have the well pipe centered therebetween.

19. A process as defined in claim 10 wherein the slant shafts have therein a plastic pipe filled with explosive material.

20. A process as defined in claim 19 wherein the slant shaft has the pipe filled with explosive material the full length of the slant shaft.

* * * * *